US005286083A

United States Patent [19]

Mattison

[11] Patent Number: 5,286,083

[45] Date of Patent: Feb. 15, 1994

[54] LUMBAR SUPPORT BACK REST

[75] Inventor: Philip Mattison, Forest Lake, Minn.

[73] Assignee: Core Products International, Inc., St. Paul, Minn.

[21] Appl. No.: 772,164

[22] Filed: Oct. 7, 1991

[51] Int. Cl.[5] ..... A47C 7/02

[52] U.S. Cl. ..... 297/230.12; 297/452.29; 297/284.1

[58] Field of Search ..... 297/231, 460, 284 D, 297/284 R, 284 C, 452, 457, 458, 483

[56] References Cited

U.S. PATENT DOCUMENTS

D. 226,062 1/1973 Corchran .
D. 268,803 5/1983 Roberts .
D. 281,210 11/1985 Roberts .
D. 300,856 4/1989 Bojsen-Moller .
1,322,292 11/1919 Claus .
3,197,255 7/1965 Caudill .
3,716,270 2/1973 Frazier .
4,328,993 5/1982 Trotman et al. ..... 297/453
5,022,709 6/1991 Marchino .

*Primary Examiner*—Jose V. Chen
*Attorney, Agent, or Firm*—Haugen and Nikolai

[57] ABSTRACT

A lumbar support back rest having an interior ribbed structural member. The structural member has general configuration which conforms to the curvature of the human back and protruding ribs which conforms to a user's back. A resilient removable covering surrounds the interior structural member and contains a strap to hold the lumbar support back rest on a chair, car seat or the like once it is properly positioned.

6 Claims, 4 Drawing Sheets

LUMBAR SUPPORT BACK REST

FIELD OF THE INVENTION

This invention relates to a back support, more particularly to a lumbar support back rest having a structurally ribbed support covered by a resilient material.

BACKGROUND OF THE INVENTION

Various back supports have been commonly used by individuals suffering from back discomfort. Back supports operate to promote proper posture while providing firm support and comfort to the user's back. Back supports are commonly portable so the user can use the same support in a variety of chairs, seats or the like.

It is in known in the art to utilize accurate shaped back supports which cooperate with the natural curvature of the individuals back. In order to provide appropriate support, back supports can be bulky and inconvenient for the user. Furthermore, the thickness and bulk of the back support allows it to retain the body heat further discomforting the user.

Therefore what is needed is a back support having less bulk while still providing the necessary support and comfort by eliminating heat build up.

The primary object of the invention is to provide a ribbed design having excellent support and user comfort while allowing the support to be manufactured out of a thinner material.

Another object is to provide a protruding rib design with corresponding indentations to allow cool air to flow through the support.

Yet another object is to provide protruding ribs with corresponding indentations which allow lateral lumbar support and which conform to the regular user's body.

SUMMARY OF THE INVENTION

The invention is a lumbar support back rest having an interior integrally molded plastic structural member having a plurality of protruding vertical ribs and opposing aligned indentions. These ribs and indentions allow air to flow through the support. The exterior of the lumbar support back rest is a removable covering. This covering has a front panel and back panel. The back panel is attached to the front panel along its edges. The back panel has an upper and lower portion which overlap. The overlap operates as an opening through which the interior ribbed structural member can be inserted or removed. The lower portion of the back panel is made of a material such as simulated leather which increases the useful life and reduces wear to chairs, car seats, and the like. The covering also contains strap holders for holding a strap to be used to attach the back support to the chair, car seat or the like to properly position the lumbar support back rest for the user. The device has a elongated S-shape and slight arcuate shape which conforms to the natural curvature of the user's back. A resilient foam material is placed between the front panel and the structural members to further promote comfort.

For a better understanding of the above and other features and advantages, references made to the following and detailed description of preferred embodiment reflected in the accompanied drawings in which like numerals in the several views refer to corresponding parts.

DESCRIPTION OF THE PREFERRED EMBODIMENT

Figure 1:
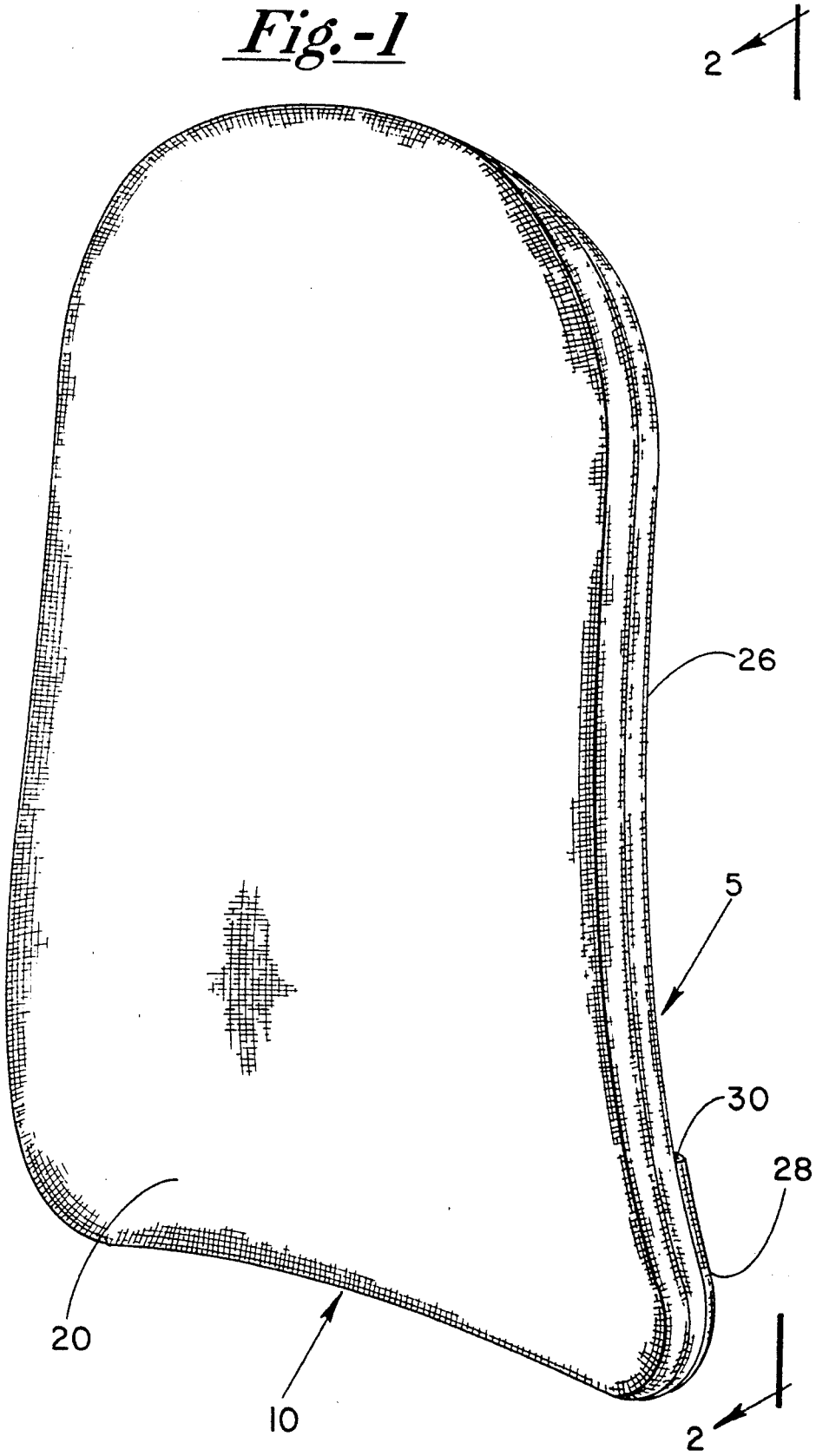
FIG. 1 is a perspective view of the invention.

FIG. 1 shows the invention depicted generally as 5. It has a covering 10 over an interior integrally formed structural member 15 shown in FIGS. 3, 4 and 5. Covering 10 has a first panel 20 and an opposing second panel 25, the second panel has two portions 26 and 28 which overlap to create an opening into the interior of the covering. The first and second panels are connected along the peripheral edge of the back rest such as with stitching which can be seen in FIG. 5. The second panel 25 contains strap holders 32 and 34. The covering can be made out of any comfortable material however, the lower portion 28 of the second panel contains a more durable material, such as simulated leather. This material increases the wear of the lumbar support back rest 5 and prevents wear of the surface on which the back rest is placed.

Figure 3:
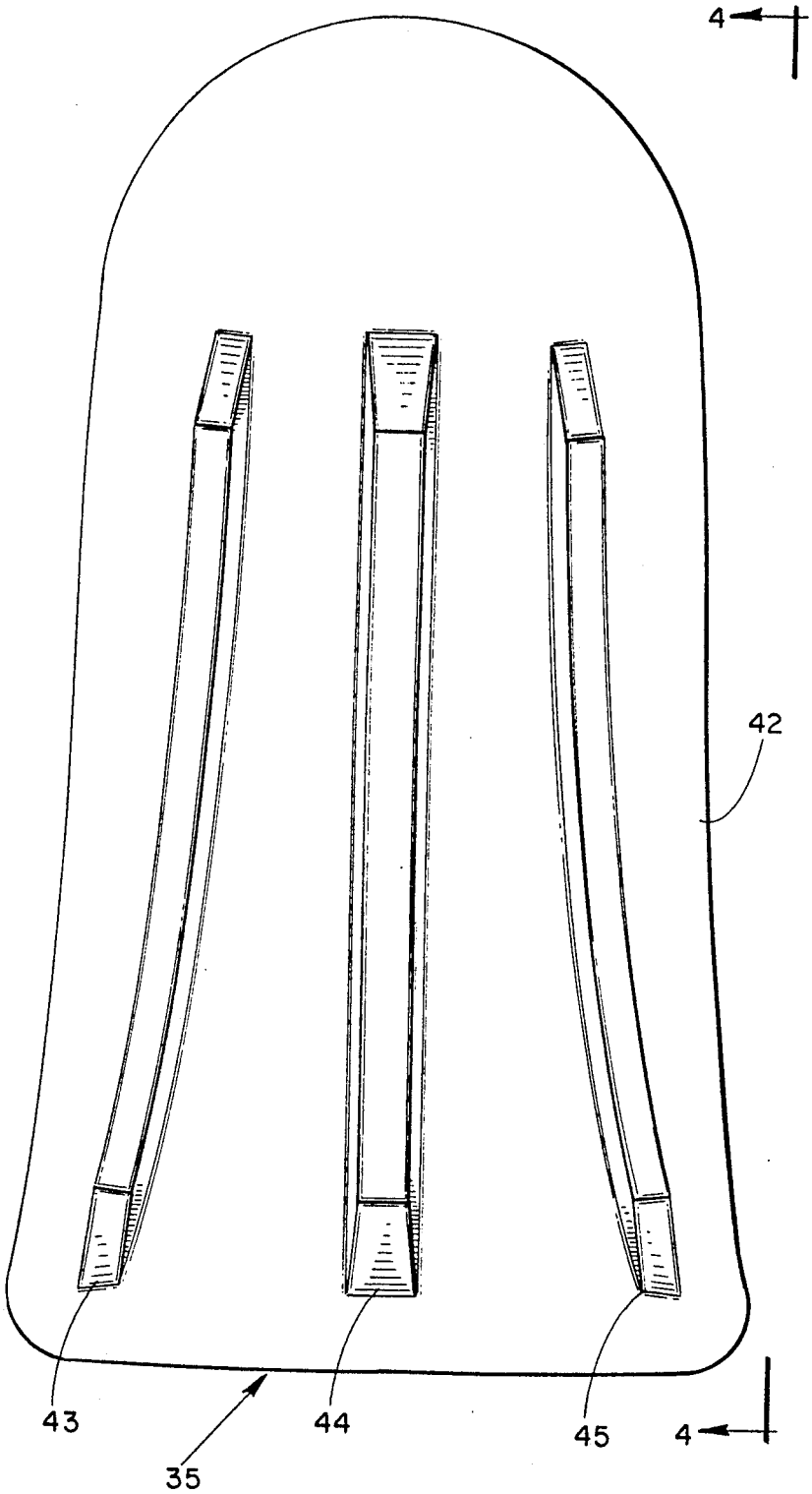
FIG. 3 is a view of the back of the interior portion of the invention.
Figure 4:
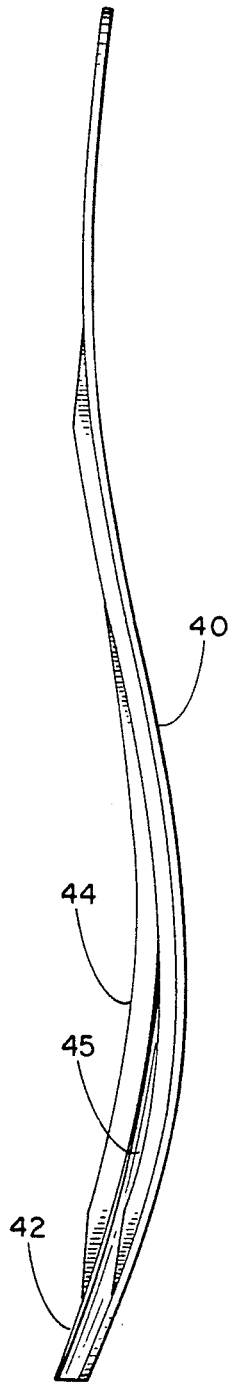
FIG. 4 is a side view of the interior portion of the invention.
Figure 5:
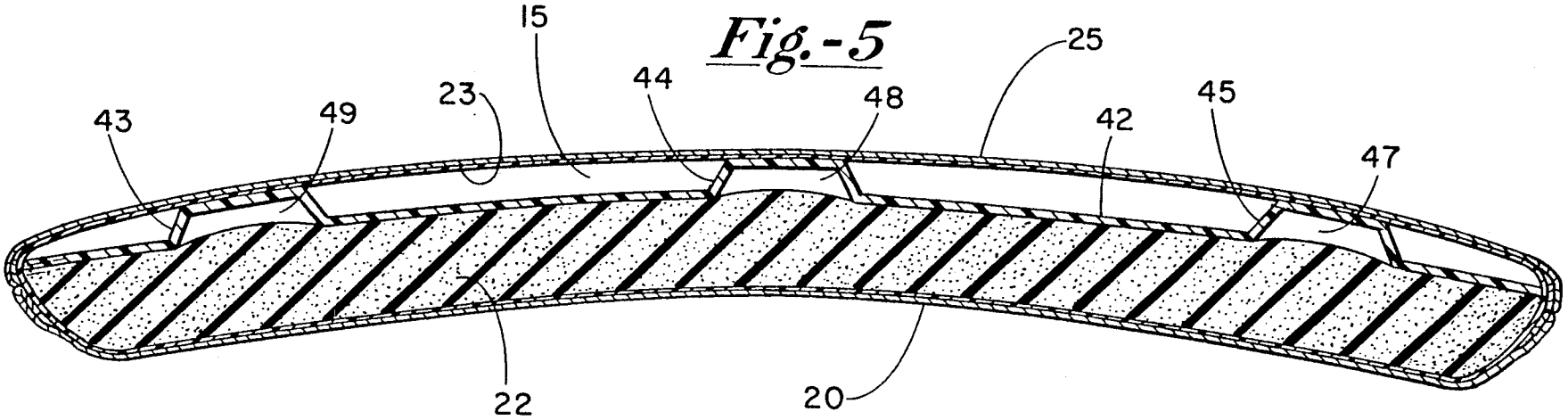
FIG. 5 is a cross sectional view of the invention taken along line 5—5.
Figure 6:
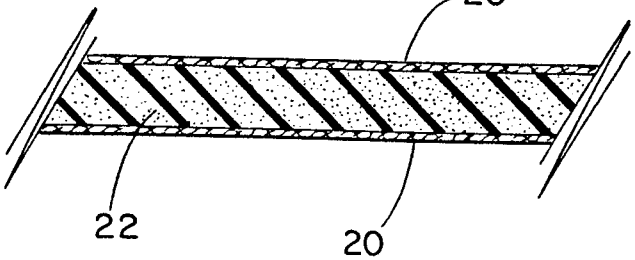
FIG. 6 is an enlarged detail of the front and back cover.

Referring now to FIG. 3 and 4, the interior 15 has a generally elongated S-configuration and first and second surface 40 and 42. Such a configuration is designed to adapt to the general natural curvature of the spine to provide appropriate support. The lumbar support back rest also has a slight lateral arcuate shape as seen in FIG. 5. This arcuate shape is minimal i.e. less than 25% and is not designed to wrap around the user's sides. Such a arcuate shape helps conform the support to the user's back shape.

FIG. 3 shows three vertical ribs 43, 44 and 45 protruding from the first surface 42 of the interior structural member. Indentions 47, 48, and 49 are located on the second surface 40 opposing the ribs as shown in FIG. 5. The ribs 43, 44 and 45 are structurally beneficial because they allow a thinner structural member to be manufactured from a molded plastic while still providing excellent support. Cool air flows through the indentions 47, 48 and 49 and between the ribs 43, 44 and 45 making the back rest comfortable to the user by inhibiting heat build up.

The lumbar support back rest is assembled by first placing a foam material 22 on the second surface 40. This can be held in place by simple plastic sheeting 23. The interior member 35 and foam material 22 is inserted into the covering 10 through the opening at 30 such that the first panel 20 will cover the foam material 22 and the second panel 25 will cover the second surface 42.

Figure 2:
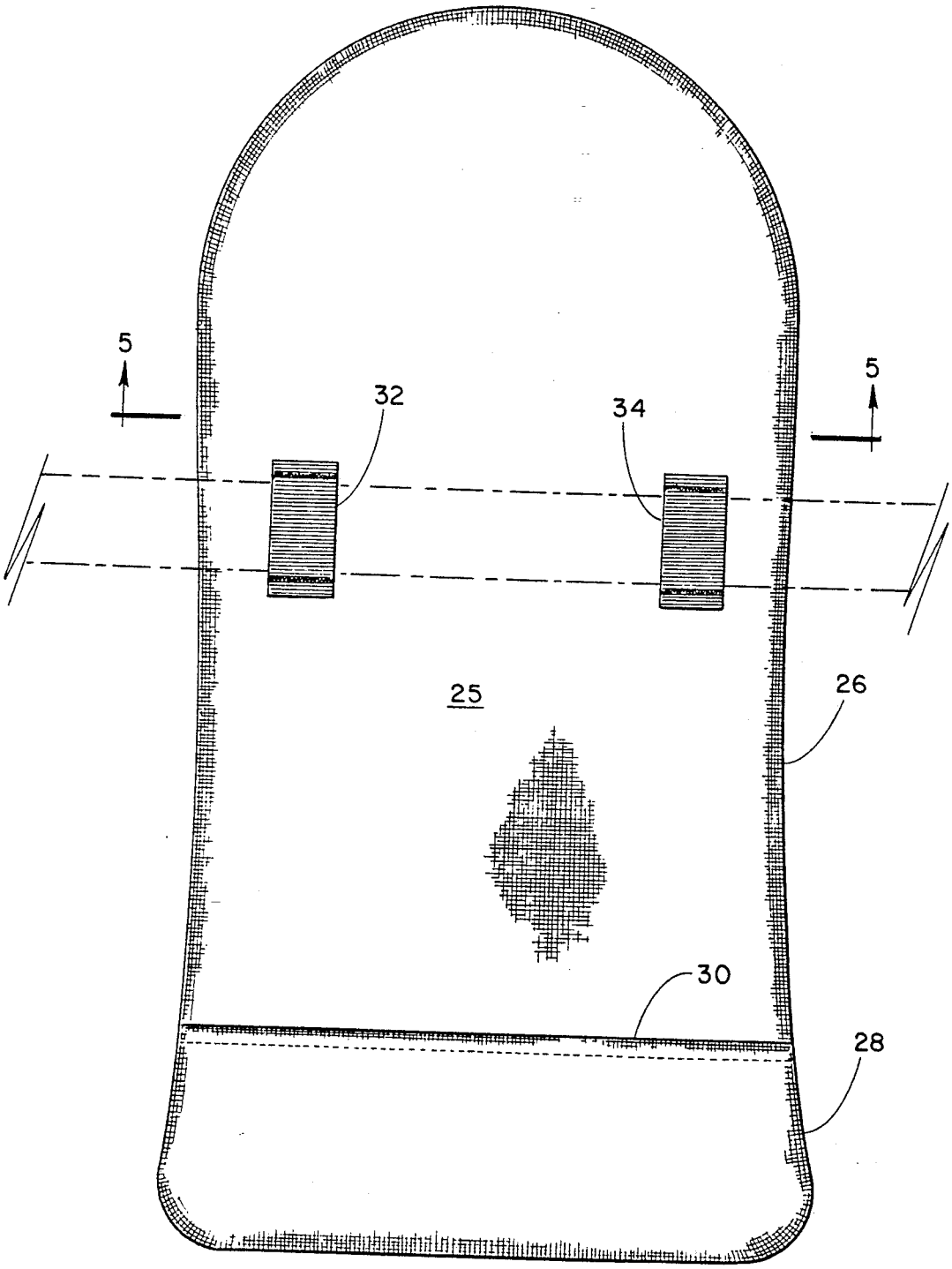
FIG. 2 is a view of the back of the invention.

The lumbar support back rest is used by placing it on a chair, car seat or the like. The second panel is placed next to the chair back or the like. A strap, shown in broken line in FIG. 2, extends through the strap holders and is used to securely fix the lumbar support back rest in the proper position. The lumbar support back rest can be a variety of sizes to meet the needs of the general population. As the user uses the lumbar support back rest, the back support will conform to the user's body while still maintaining the proper lower lateral lumbar support.

It is to be understood that the above disclosure of the presently preferred embodiment of the invention is to be taken as illustrative of the invention. Furthermore, it is to be understood that those of skill in the art be capable of making modifications without departing from the true spirit and scope of the invention.

What is claimed is:

1. A lumbar support back rest having a general configuration conforming to a human spine, said lumbar support back rest comprising:

(a) a structural member having a first and second surface, said first surface having a plurality of vertically oriented protruding ribs and said second surface having a plurality of vertically oriented indentations opposing said plurality of ribs to define channels;

(b) a resilient material located on said second surface without occluding said channels; and;

(c) a covering surrounding said structural member.

2. The lumbar support of claim 1 wherein said structural member is made from a molded plastic.

3. The lumbar support of claim 1 wherein said covering is removable having a first panel and an upper portion and a lower portion of a second panel, said first and second panels attached along a peripheral edge whereby said upper portion and lower portion of said second panel overlap forming an opening to a covering interior.

4. The lumbar support of claim 3 wherein said lower portion of said second panel is made of a durable material.

5. The lumbar support of claim 4 wherein said durable material is simulated leather.

6. The lumbar support of claim 1 wherein said resilient material is a foam material.

* * * * *